United States Patent [19]

Masuda

[11] 3,978,556

[45] Sept. 7, 1976

[54] PROCESSING SYSTEM FOR WOVEN, KNIT OR SIMILAR SHAPED MATERIALS

[75] Inventor: Masao Masuda, Nagoya, Japan

[73] Assignee: Masuda Manufacturing Co., Ltd., Nagoya, Japan

[22] Filed: Dec. 5, 1974

[21] Appl. No.: 529,970

[52] U.S. Cl. ..... 68/62; 68/177; 68/158; 26/75; 26/94; 226/112

[51] Int. Cl.[2] ..... D02C 3/00

[58] Field of Search ..... 26/54; 68/175, 176; 226/10, 37, 118, 172

[56] References Cited

UNITED STATES PATENTS

| | | | |
|---|---|---|---|
| 2,503,024 | 4/1950 | Boese et al. | 26/54 X |
| 2,613,521 | 10/1952 | Walmsley | 26/54 X |
| 3,308,639 | 4/1967 | Ziegler et al. | 68/176 |
| 3,379,494 | 4/1968 | Ziegler et al. | 68/176 X |
| 3,406,542 | 10/1968 | Kusters et al. | 26/54 X |
| 3,517,425 | 6/1970 | Hunter | 26/54 |

*Primary Examiner*—Louis K. Rimrodt
*Attorney, Agent, or Firm*—Flynn & Frishauf

[57] ABSTRACT

A textile processing system in which a textile material to be treated is led and conveyed through a predetermined path for processing by the provision of a material guidance device on both side-walls of the processing system. The system provides open-width processing, low liquor-ratio processing and continuous processing, and contributes to a solution of the problems in regard to industrial waste-water control.

19 Claims, 23 Drawing Figures

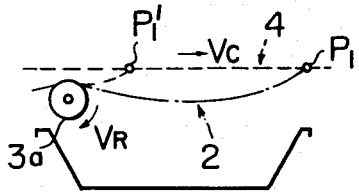
Fig. 2a
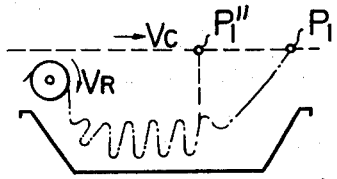
Fig. 2b
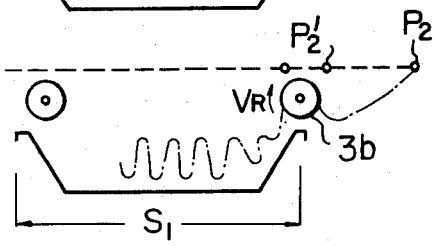
Fig. 2c
Fig. 3
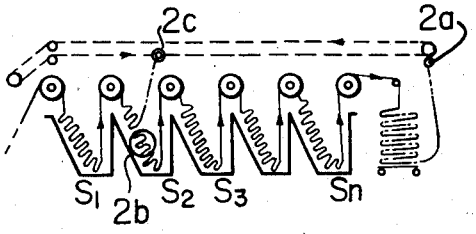

PROCESSING SYSTEM FOR WOVEN, KNIT OR SIMILAR SHAPED MATERIALS

BACKGROUND OF THE INVENTION

The invention described herein is related to a processing system for textile and similarly shaped materials. Particularly, the present invention is related to a processing system for dyeing or other processings of knit or woven materials and their open-width and continuous processings.

A particular and externally obvious feature of the present invention is to lead and convey a material through a pre-determined path for processing by the provision of a material guidance device on both sidewalls of a processing system.

Processing systems with a side-wall mounted material leading device such as a set of end-less chain for painting, chemical coating, drying or baking, for instance, are publicly known. As for the aspect of textile processing such as dyeing, however, there has never appeared an apparatus conveying textiles to be treated by means of a side-wall mounted endless guidance as, for example, a set of roller chain. The processing system based upon the invention is not only restricted to the open-width processing but also applicable to the processings of materials in rope-form.

Generally, industrial immersed processing systems are categorized into rope-form processing and open-width processing, in terms of the state of a material being processed, of which the winch or jet dyeing process and the jigger dyeing process are typical examples respectively. According to the textile processing industry's text, the winch dyeing process is generally considered to produce deep and even coloring by its full and relaxed immersion and relatively long material immersion time, while a light-coloring effect near the center of a material is often inherent to the jigger dyeing process. On the contrary, the jigger dyeing process is generally effective to avoid producing crease marks, to process with a low dye-liquor-to-material (weight) ratio and to achieve high processing efficiency for its operational simplicity. Furthermore, in jigger dyeing, the ease of color-matching for repeated processes and possible utilization of left-over dye-liquor in a following dyeing cycle are considered to be advantageous. However, because of the low liquor-ratio and highly repetitions immersion processing of the jigger dyeing which results in short transient material immersion time, the use of dye-stuffs with first migration characteristics tends to turn out such undesirable effect as uneven and/or shallow surface-dyeing.

Furthermore, according to cumulative experience, it is considered to be essential for the winch or jet dyeing process to maintain such high liquor-to-material (weight) ratios as 20 to 1 in order to achieve even dyeing with the material speed as low as 50 to 120 m/min which is the upper most rope-form material speed for winch or jet dyeing equipments not to cause excessive and unevenly distributed tension in the subjected material due to twisting of the material and friction between the material and a conveyance device such as a frame-type reel.

The processing system of the invention, which combines the advantageous features of both rope-form (winch or jet) and open width (jigger) processing methods while minimizing their disadvantageous influences, enables to achieve a maximum processing material speed as high as 250 m/min and a processing liquor-to-material (weight) ratio as low as 6 to 1 or 10 to 1 by the system's open-width processing feature which contributes to an even distribution of tension in a subjected material and a consistent motion of the loaded material immersed in a processing solution, while simultaneously increasing chemical reaction efficiency by the uniformity of the state of contact between the processing solution and the immersed material.

Besides the system's so-called low-liquor-ratio processing feature which substantially (by the factor of 3.3 in the case of the 6 to 1 processing liquor-ratio, against a normal 20 to 1 processing liquor-ratio of the winch or jet dyeing process) reduces the amount of required processing solution per a unit material and consequently minimizes the after treatment for used processing solution, the features such as high chemical reaction efficiency and processing uniformity are also effective to achieve a better processing economy. Furthermore, the features such as high labor productivity that is typical of the jigger dyeing process and the ease of quality control of the winch or jet dyeing process are conserved by the processing system — with the mechanized material handling and processing features and the full and relaxed immersion, respectively — of the invention.

In addition to the features described above, the processing system of the invention enables to compose a unique continuous processing system that is highly flexible in processing materials selection and adapting varied processing requirements (methods) on the contrary to conventional continuous processing means, for the system's flexibility in processing control that is due to the fact that each processing system in the continuous processing range can be controled independently from other sub-systems. The significances of the achievement of a further increase in productivity by such continuous system than it is possible with a single-system operation and the need of such efficient processing mean in today's cost-conscious industry are apparent. For another example, the continuous processing system of the invention enables to provide a closed-type processing system such as a high-pressure vessel in the continuous processing range (ref. FIG. 9) without such sealing elements as nip-rolls which are tightly pressed against a material when the material passes through inlet and outlet openings, so that such matters as color- and pattern-mixing on printed materials and damaging material bulkiness are fundamentally avoided. Furthermore, when it is used for steaming, for instance, any suitable processing time can be selected, without the extension of a processing equipment in order to extend a traveling time of a material through the equipment, by recirculating a subjected material in the processing system for any designed length of time before subjecting the material to another operation.

Although the invention is mainly described in the following sections as a dyeing apparatus, it is not only related to a dyeing purpose but also applicable to various other purposes such as scouring, bleaching and relaxing, to the processing of delicate materials such as knit goods for which low-tension processing and processing uniformity are essential and, in principal, to the purposes such as drying and steaming. Furthermore, the processing system of the invention is not only suitable to knit or woven materials but, in principal, also applicable to the processings of the materials other than textile products.

As indicated in the preceding sections, this is the invention with the three primary features which are open-width processing, low-liquor-ratio processing and continuous processing with versatility which is based upon its applicant's long experience in the field of textile processing and his consciousness about industrial feasibility and introduces a new mean to deal directly with the shortcomings of existing processing technology and the problems in regard with industrial waste-water control that is one of the most concerned matter in today's industry.

SUMMARY OF THE INVENTION

1. The system of the invention is equipped with a material guidance device (such as a pair or more of endless chain installed to the side walls of a processing system), a material attachment device which is laterally installed to the guidance device and one or more processing sections which compose a processing system. When a continuous processing system (i.e., a series of processing systems, in combination) is composed, material feed, transfer (between adjacent systems) and take-out and carrier devices — functionally inter-connecting each sub-systems and their varied operations and executing initial and final material handling operations systematically — are also installed to the larger (continuous) system.

2. A material to be processed is attached to the material attachment device in open-form. Being led by the material guidance device through a pre-determined path and forwarded by the conveyance devices which are arranged in parallel with the guidance device and the processing sections, the material is treated in open-form throughout its entire processing period.

3. By the proper selection and control of the order and the inter-connections of the processing sections and the material guidance devices, the system can be adapted to such varied processing patterns as the case of open-width folded loadings and processing, the case of recirculated processing, the case of non-circulated processing, the case of continuous high-pressure processing and/or the combinations of the varied patterns.

4. Initial and final material handlings, processing operations of various patterns and their combinations and material transferrings and inter-connections of each subsystem in the larger system are remotely and automatically — by an auxiliary programing device — controlled.

The details of the precedingly described outlines and the purposes not mentioned in the preceding sections are illustrated in the followings.

BRIEF DESCRIPTION OF THE DRAWINGS

In FIG. 1*a*, the path of the material guidance device encircles a processing section, while the return path of the guidance device is over the processing section in FIG. 1*b*.

FIGS. 2*a*, *b* and *c* show the state of the material in processing sections following its leading-end and the relative positions of the leading-end corresponding to the variations of the state.

FIGS. 3 and 4 show simple operational conceptions schematically of linear and multi-layered configurations respectively.

DETAILED DESCRIPTION OF THE INVENTION

Figure 1A:
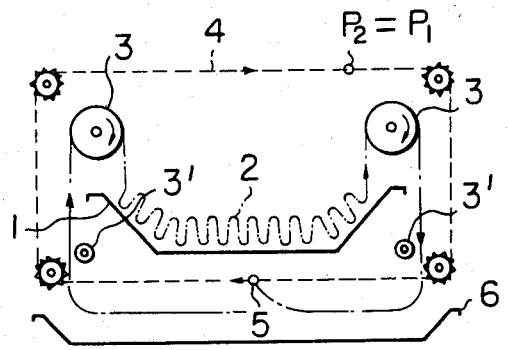
FIGS. 1*a* and *b* schematically show the basic configuration of the processing system of the invention.
Figure 1B:
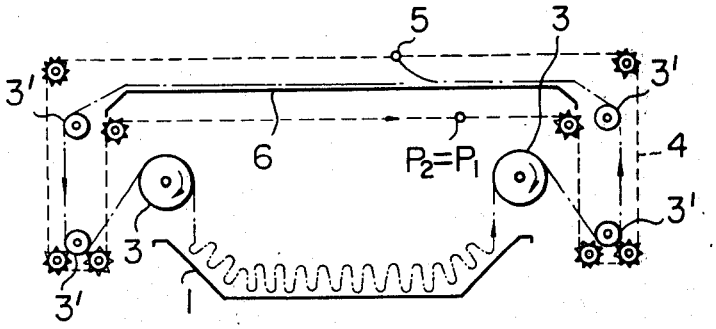

In FIG. 1, showing the basic composition of the invention, the elements such as processing vessels or processing sections 1; a material 2 to be processed, main reels 3; main conveyances device, guide rolls 3', endless tracks 4 of the material guidance device, the material attachment device 5 and a guide beck 6 of FIG. 1*a* or a guide plate 6 of FIG. 1*b* are shown. The specification P2 = P1 is referred later in accordance with FIG. 2.

When a material — being led by the material guidance device, initially — reaches a predetermined position that is located relative to the position of a conveyance means, the power to convey a material is transmitted to the material by the conveyance means. For the conveyance means, a hexagonal drum-type reel (FIG. 4, 5), or the use of a conventional frame-type reel or more special means such as a drum-reel, a modified polygonal drum-reel, a suction drum, a conveyor and water-jet is considered. Furthermore, the patterns of loading and processing operations are determined by a suitable relative arrangement of the material guidance device and the material conveyance means as described above.

As shown by FIGS. 2*a* – 2*c*, when a leading-end of a material 2 is located in the interval P1' - P1, the following portion of the material overlaying the main reel 3*a* is supplied to the processing section S1 with the circumferential speed $V_R$ of the main reel. The amount of a material which is held continuously in a processing section and a unit processing time per one processing section are controlled by the circumferential speed $V_R$ of the main reel and withholding the advancement of the leading-end of the material if $V_R = Vc$ in which $Vc$ is the linear speed of the leading-end, or by the relative speed difference between $V_R$ and $Vc$ and the time required by the leading-end to travel the distance between the interval P1' - P2' (of FIG. 2*c*) — including the time of withholding when such an operational pattern is selected — if $V_R > Vc$. FIG. 2*b* shows an intermediate state in the case of $V_R > Vc$. After a certain time-interval for the advancement of the leading-end to P2 from P2', the material is carried out by the main reel 3*b* from the processing section S1.

Three operational configurations, based upon the principal described so far, such as listed below are considered:

1. Recirculated processing path type

As shown in FIGS. 1*a* and 1*b*, the track of the material guidance device encircles a processing section. To be noted in this that the position P2 in FIG. 2*c* corresponds to the position P1 in FIG. 2*a;* indicated by P1 = P2 in FIGS. 1*a* and 1*b*.

2. Multi-section processing path type

As shown in FIG. 3, more than one processing section (S2, S3, . . . . S*n*) is arranged linearly along the track of the material guidance device. In this type, the position P2' or P2 in FIG. 2*c* sequentially corresponds to the position P1' or P1 respectively in an adjacent processing section. (Also shown in FIG. 3 is the loading of a new material of which a leading-end is indicated by 2*c* while a finished material — indicated by 2*a* for its leading-end and 2*b* for its tail-end — is being taken out.)

3. Multi-section recirculated processing path type

Figure 4:
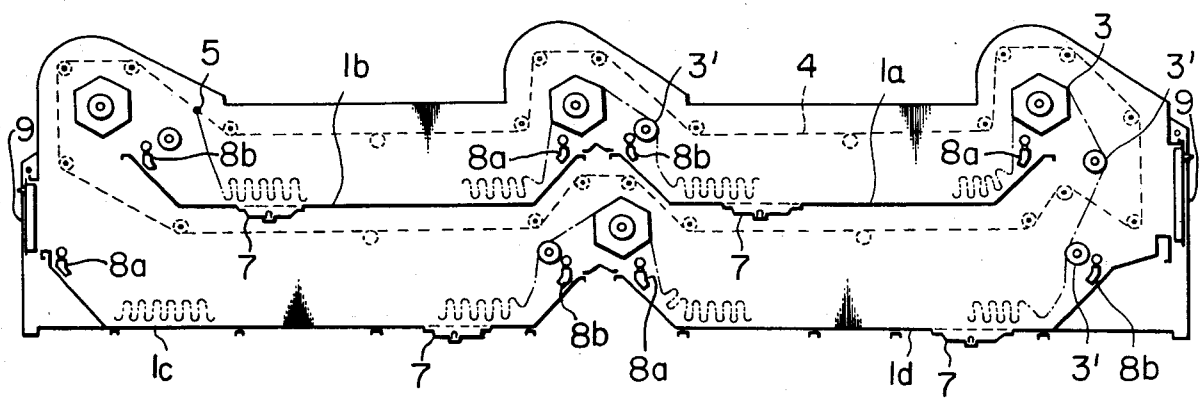

As shown in FIG. 4, the features of the above two types are combined. The schematic figure, which shows a simple operational scheme, indicates such parts as four processing sections 1*a*, 1*b*, 1*c*, 1d which are arranged in a layered manner, hexagonal drum-type main reels 3 with material (centering rolls 3'; shown in more detail in FIG. 5, the track of the material guidance device 4; auxiliary water-jet outlets 8*a* and 8*b*, their inlet ports 7 and front and rear doors 9 are also shown in the figure. Furthermore, it should be noted that the leading-end 5 of a material is located above the processing section 1*b*, while its tail-end is in the processing section 1*c*. Water jet outlets 8*a* produce water current flow in the direction of advancement of the material and water jet outlets 8*b* produce water current flow against the direction of advancement of material. Although the scheme is presented in FIG. 4 with a double-layer-four-section configuration, the processing system of this type as well as the other two types can be arranged in various other ways so that a specific processing need is handled in a most efficient way.

Figure 5:
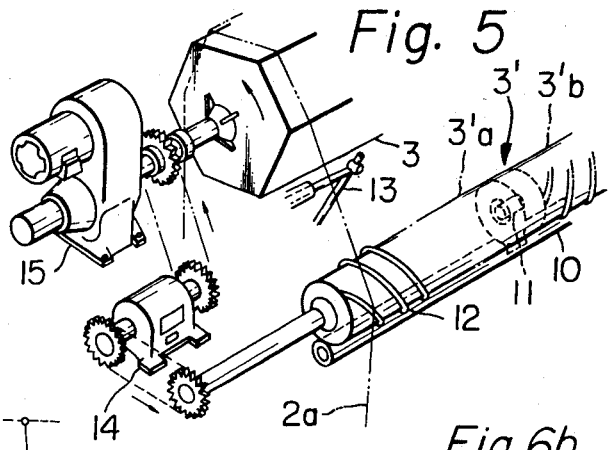
FIG. 5, shows major elements of a simple example of the material conveyance device.

The material centering roll 3' shown in FIG. 5, a simple example of a material centering device, is also indicated in FIGS. 1 and 4. The centering device of this type having two separately driven rolls 3'*a*, 3'*b* with two independent brake-clutch units 14 adjusts the path of a material when it is off-centered and touches a feeler element e.g. 13 by braking the roll e.g. 3'*b* of the opposite — to the touched feeler element — side and guiding the material along its spirally wound friction element 12; in FIG. 5, an oil-less bearing 11 and a supporting element 10 are also shown.

Figure 6A:
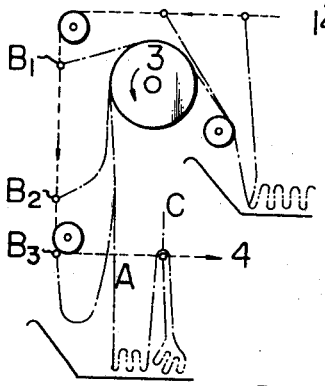
FIGS. 6*a*, *b*, *c* show how the material is supplied and led — by the conveyance and guidance devices respectively — into the lower layer of processing sections in the multi-layered system.
Figure 6B:
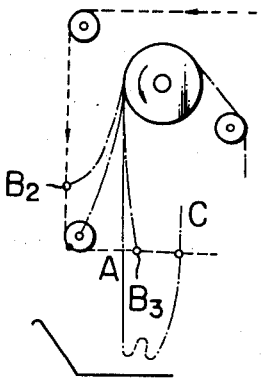
Figure 6C:
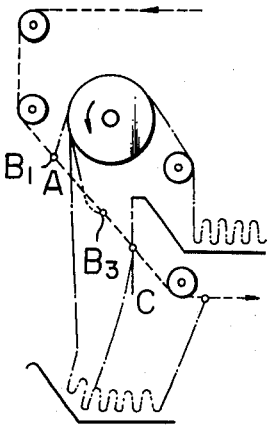

In FIG. 6, the interface of the two layers such as the one shown in FIG. 4 is indicated. If a relative entering speed between a leading-end of a material and a following portion of the material is improperly selected, the portion of the material which should always be following the leading-end enters a lower processing section before the leading-end B reaches the line-A of material entering. When this is the case as in FIG. 6*a*, an overlapping *c* of the material with the leading-end occurs. A proper material entering state, for which the relative entering speed is selected, is shown in FIG. 6*b*. An alternative method to avoid the overlapping by the provision of the track of the guidance device in such a way as the time required by the leading-end to reach the line-A is reduced and the timing for the conveyance of the following portion of the material to be started is delayed.

By combining a material transfer device with the precedingly described operational configurations, more than one processing system can be functionally inter-connected to compose a larger system. Such system enables to handle a complex processing requirement that has been practically inapplicable to more conventional continuous processing systems. The the composition of the system can be selected to best fit a specific requirement while reserving the inherent operational flexibility of each sub-system.

Figure 7:
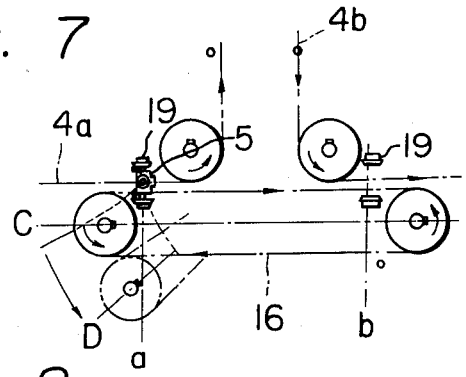
FIG. 7 schematically shows a simple example of the material transfer device inter-connecting two adjacent processing systems.

In FIG. 7, a simple example of the material transfer device is shown schematically. In principal, it is a device to bridge the tracks 4*a*, 4*b* of the material guidance devices in two adjacent systems by providing a third track 16 which transfers a detachable material attachment device 5 between the two adjacent systems. In FIG. 8, the case, of the same principal as the one described above, inter-connecting two adjacent closed-type processing systems is shown.

Figure 8A:
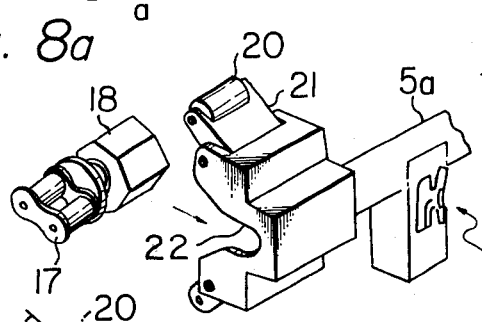
FIGS. 8*a* and *b*, show a simple example of the detachable material attachment device for automatic mechanized transferring operations between adjacent systems.
Figure 8B:
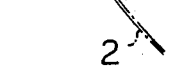
FIG. 8*c*, on the other hand, shows a corresponding simple example of a receiving mechanism on the material transfer device.
Figure 8B:
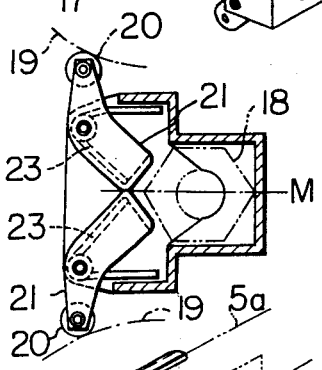
Figure 8B:
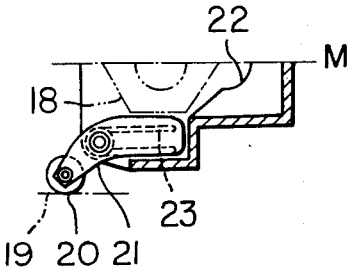
Figure 8C:
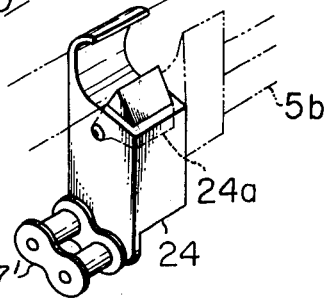

The schematic drawings in FIG. 8*a*, 8*b* and 8*c* show the parts — required for a transferring operation as suggested by the examples in FIGS. 7 and 8 — such as a link 17 of the roller chain track 4*a*, 4*b* of the material guidance device, a connector element 18, buckling mechanisms 20, 21, 23 of the detachable material attachment device, 22 being a pair of cover plates for retaining the connector 18, a link 17' of the roller chain track 16 of the material transfer device and latch mechanisms 24 on the transfer device. A transverse connecting rod 5*a*, 24*a* being a claw or click stop device, and a material attachment rod 5*b* that is attached to the connecting rod as indicated by an arrow which constitute the detachable material attachment device 5 together with the buckling mechanisms and a material 2; (indicated by imaginary line) attached to the material attachment rod are also shown in the figure.

Figure 9A:
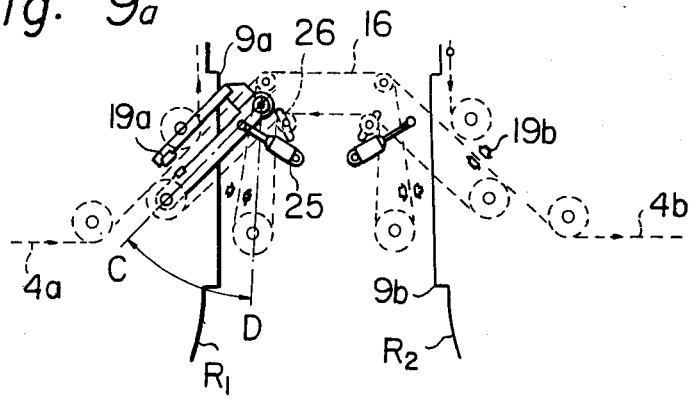
FIGS. 9*a* and *b* show the transfer device inter-connecting two adjacent closed-type processing systems schematically.

When the leading-end of a material comes to a predetermined position *a*, FIG. 7, a cam mechanism 19, FIGS. 7, 8, 9 opens stopper pins 21 by pressing rollers 20, thus releasing the material guidance device from the connector element 18 of the guidance device; ref. FIGS. 8*a* and 8*b*. It should be noted, however, that the cam mechanism and the track of the transfer device moves to the positions specified by *a* and *c* respectively only when a transferring operation is required; when a processing of a material is normally executed, the track and the cam mechanism are retracted to the position specified by D and an off-track position corresponding to the retraction of the transfer device respectively. The material attachment device that is released by the cam mechanism from the connector element on the track of the guidance device is then gripped by the latch mechanism 24 of which a spring loaded latch is specified by 24*a* and moved forward along the track 16 of the transfer device to the position specified by *b*. At the position *b*, the motion of the track of the transfer device is withheld; to be noted is that the stopper pins 21 are opened by the cams 19 simultaneously. Then, the connector element on the track 4*b* of the guidance device in an adjacent system is connected to the withheld material attachment device, while disconnecting the attachment device from the latch mechanisms of the transfer device simultaneously. Finally, the track of the transfer device with the cam mechanisms is retracted to an off-track position to complete a transfer operation.

Figure 9B:
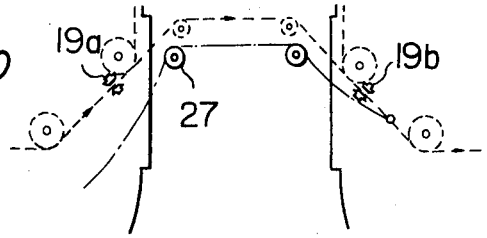

The example of the material transfer device described above in accordance with FIGS. 7 and 8 are shown in a more specific way in FIG. 9, with sections R1, R2 of two adjacent closed-type processing systems, material transferring ports 9*a*, 9*b*, cylinder-actuator type mechanisms 25 to retract the transfer device, spring loaded tension rollers 26 to maintain constant tension in the track of the transfer device and material guide rolls 27. Shown separately in FIG. 9*b* is the state of a material 2, (indicated by imaginary line) entering an adjacent processing system through the transfer device.

Figure 10:
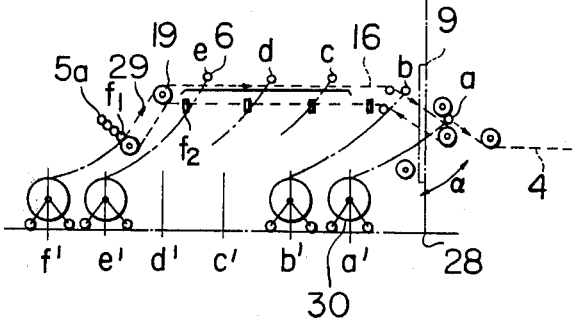
FIG. 10 shows an example of a continuous mechanized leading system schematically.

A simple example of an initial feeding device is shown in FIG. 10. The shown feeding device fundamentally is based upon the functional principal of the material transfer device and, thus, shares the parts such as the track 16, the latch mechanisms *f*2 and the mechanisms for transferring the leading-end of a material between two adjacent tracks with the material guidance device. To be noted is that the angle $\alpha$ in FIG. 10 corresponds to the angle between the positions specified by C and D in FIGS. 8 and 9. In FIG. 10, the track 4 of the material guidance device, a section 28 of a closed-type processing system, a material feeding port 9, material rolls 30 which are ready to be processed, their positions *a'* to *f'*, the positions *a* to *f*1 of their leading-ends attached to the material attachment devices 6 on the track of the feeding device, the reserve detachable material attachment devices 5*a* and the track of the sub-guidance device which functions like the material guidance device when transferring the material attachment device are shown. This system enables to prepare a large number of materials to be processed at a time, no matter how the processing requirements for each material differs from one another, leaving the control of such variations in the processing requirements to the processing system which has, in accordance with the invention, a designed flexibility to meet such requirements.

Figure 11A:
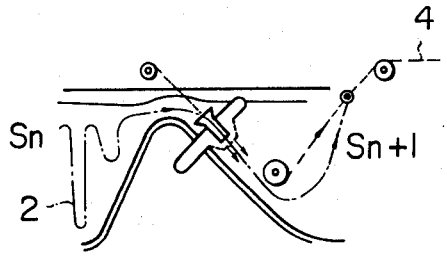
FIGS. 11*a*, *b*, *c* and *d* show various alternative examples of material conveyance means.
Figure 11B:
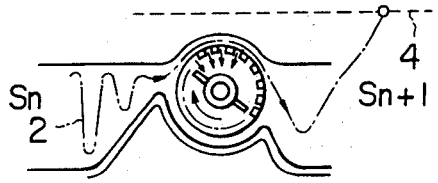
Figure 11C:
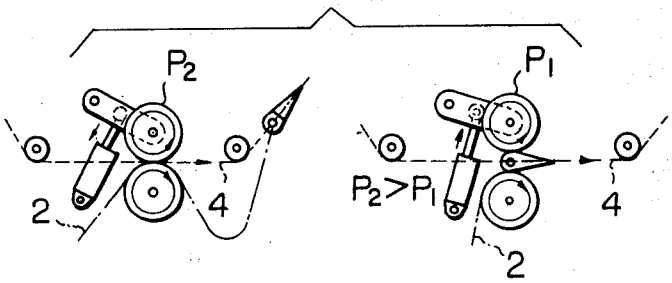
Figure 11D:
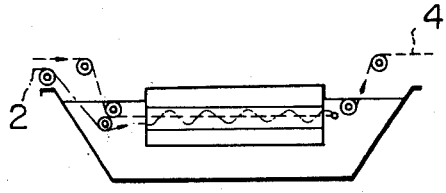

Some simple variations of the conveyance device and examples of additive mechanisms are shown in FIGS. 11*a*–11*d* with a material 2 and the track 4 of the guidance device indicated by an imaginary line a break line respectively; S*n*+1 indicates a processing section following a section S*n*. In FIG. 11*a*, a water-jet conveyance means is shown. In FIG. 11*b*, a suction-drum conveyance means is shown. The case to process a material through two contacting rolls, such as squeeze rolls, is shown in FIG. 11*c;* P2>P1 indicates that a normal processing pressure P2 exerted by means of a power cylinder for instance is reduced to a pressure P1 due to the weight of roller (P2 = o, in other words) when a wedge-shaped element attached to the material attachment device passes through the rolls. In FIG. 11*d*, the case to process a material through an additive processing means such as an infra-red ray heater or a microwave reactor is shown.

I claim:

1. A processing system for woven, knit or similarly shaped materials, comprising:

at least one processing section with a processing bath;

an elongated moving material guidance device passing completely through the at least one processing section and;

a material attachment device which is mounted above the bath on the guidance device and oriented transversely relative to the direction of movement of the guidance device and movable with the guidance device for engaging a material to be processed and moving the material through the at least one processing section according to the motion of the guidance device an initial material feeding device for feeding material to the material attachment device; and final material take-out and carrier-transporter devices operatively coupled to the material guidance device.

2. A processing system according to claim 1, wherein the material attachment device includes means for engaging the material with the material in an open-width (flatly spread) form; and the at least one processing section includes conveyance means for transporting the material, led by the guidance device, through the at least one processing section in open-form.

3. A processing system according to claim 2 wherein said conveyance means includes means for varying the speed at which the material is transported through a processing section.

4. A processing system according to claim 2, comprising a plurality of processing sections which are horizontally adjacent each other, and including inter-section material transfer means for transferring material between adjacent sections.

5. A processing system according to claim 4, comprising a plurality of processing sections arranged in a multi-layered manner with sections vertically spaced from other sections, and including inter-section material transfer means for vertically transferring the material from one of said vertically spaced sections to the next of said vertically spaced sections.

6. A processing system according to claim 2, comprising a plurality of processing sections arranged in a multi-layered manner with sections vertically spaced from other sections, and including intersection material transfer means for vertically transferring the material from one of said vertically spaced sections to the next of said vertically spaced sections.

7. A processing system according to claim 6, including means for avoiding hanging down of a material between a material conveyance means of the upper layer and the front of a material attachment device while the attachment device is entering the lower layer of processing sections at the interface section of the upper and lower layers, said means including means for shortening the track of a material guidance device, so that a portion of the material following its leading-end always follows the leading-end and the material attachment device at the interface.

8. A processing system according to claim 6, including means for avoiding hanging down of a material between a material conveyance means of the upper layer and the front of a material attachment device while the attachment device is entering the lower layer of processing sections at the interface section of the upper and lower layers, said means including means for adjusting the relative speed between the guidance device and the material conveyance means, so that a portion of the material following its leading-end always follows the leading-end and the material attachment device at the interface.

9. A processing system according to claim 1 comprising a plurality of processing sections cooperatively associated with each other; and wherein said elongated moving material guidance device extends so as to serially pass through said plurality of sections so as to lead, by means of the material attachment device, a material serially through said plurality of sections, each of said sections including conveyance means for transporting the material, led by the guidance device, through the respective sections and further including interstage transfer means for guiding the material from the outlet of one section to the inlet of the next section.

10. A processing system according to claim 9 wherein said elongated moving material guidance device comprises one endless conveyor mechanism extending through each of said plurality of sections, said material attachment device being mounted to the endless conveyor transversely with respect to the direction of movement of the endless conveyor.

11. A processing system according to claim 9 wherein each of said sections includes at least two water jet outlet means, one of said water jet outlet means producing water current flow in the direction of advancement of the material, and the other of said water jet outlet means producing water current flow in a direction against the advancement of material in said section.

12. A processing system according to claim 9, comprising at least four processing sections, two pairs of two horizontally adjacent sections being vertically spaced relative to each other, and wherein said elongated moving material guidance device comprises an endless conveyor passing through all of said processing sections.

13. A processing system according to claim 9 wherein said elongated moving material guidance device is, in each of said processing sections, located above the horizontal path of movement of the material being treated.

14. A processing system according to claim 1, wherein said at least one section is a dyeing section for dyeing material.

15. A processing system according to claim 1, wherein said at least one section includes at least two water jet outlet means, one of said water jet outlet means producing water current flow in the direction of advancement of the material, and the other of said water jet outlet means producing water current flow in a direction against the advancement of material in said section.

16. A processing system according to claim 1, wherein each of said sections comprises means containing a liquid processing bath, and in each of said sections said elongated moving material guidance device and said material attachment device are spaced above the upper level of said bath.

17. A processing system according to claim 1, comprising an initial material feeding device for feeding material to the material attachment device.

18. A processing system according to claim 1, comprising final material take-out and carrier-transporter devices operatively coupled to the material guidance device.

19. A processing system according to claim 1, further comprising:

an initial material feeding device for feeding material to the material attachment device; and final material take-out and carrier-transporter devices operatively coupled to the material guidance device.

* * * * *

UNITED STATES PATENT OFFICE

CERTIFICATE OF CORRECTION

PATENT NO. : 3,978,556

DATED : September 7, 1976

INVENTOR(S) : Masao MASUDA

It is certified that error appears in the above-identified patent and that said Letters Patent are hereby corrected as shown below:

Column 8, line 3, after "guidance device" insert --.--;

delete lines 4-8.

Signed and Sealed this

Sixteenth Day of November 1976

[SEAL]

*Attest:*

RUTH C. MASON
*Attesting Officer*

C. MARSHALL DANN
*Commissioner of Patents and Trademarks*